US006615802B2

(12) United States Patent
Reiter et al.

(10) Patent No.: US 6,615,802 B2
(45) Date of Patent: Sep. 9, 2003

(54) FUEL INJECTION VALVE

(75) Inventors: Ferdinand Reiter, Markgroeningen (DE); Guenther Hohl, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/089,914

(22) PCT Filed: Jul. 20, 2001

(86) PCT No.: PCT/DE01/02764

§ 371 (c)(1),
(2), (4) Date: Jul. 29, 2002

(87) PCT Pub. No.: WO02/12717

PCT Pub. Date: Feb. 14, 2002

(65) Prior Publication Data

US 2002/0179057 A1 Dec. 5, 2002

(30) Foreign Application Priority Data

Aug. 5, 2000 (DE) ..... 100 38 300

(51) Int. Cl.[7] ..... F02M 37/04
(52) U.S. Cl. ..... 123/470; 123/509
(58) Field of Search ..... 123/470, 509, 123/472, 508, 507; 239/397.5, 600

(56) References Cited

U.S. PATENT DOCUMENTS 4,589,596 A * 5/1986 Stumpp et al. ..... 239/397.5
4,938,193 A * 7/1990 Raufeisen et al. ..... 123/470
5,070,845 A * 12/1991 Avdenko et al. ..... 123/470
5,247,918 A 9/1993 Wakeman
5,752,487 A 5/1998 Harrell et al.
6,009,856 A * 1/2000 Smith, III et al. ..... 123/470
6,223,727 B1 * 5/2001 Tahara et al. ..... 123/470
6,263,863 B1 * 7/2001 Giovannini et al. ..... 123/470
6,289,876 B1 * 9/2001 Mackert ..... 123/470
6,314,943 B1 * 11/2001 Burch et al. ..... 123/470
6,334,433 B1 * 1/2002 Sumida et al. ..... 123/470

FOREIGN PATENT DOCUMENTS

DE 197 35 665 1/1999
DE 198 08 068 9/1999

* cited by examiner

*Primary Examiner*—Carl S. Miller
(74) *Attorney, Agent, or Firm*—Kenyon & Kenyon

(57) ABSTRACT

A fuel injection valve, which may be inserted into a locator bore of a cylinder head of an internal combustion engine, has a sealing ring located peripherally around the fuel injection valve in the locator bore. The sealing ring has a contact surface, having the shape of a spherical segment, toward the fuel injection valve, which presses against a corresponding counter surface, having the shape of a spherical segment, of the fuel injection valve.

16 Claims, 3 Drawing Sheets

FUEL INJECTION VALVE

FIELD OF THE INVENTION

The present invention relates to a fuel injection valve having a sealing ring.

BACKGROUND INFORMATION

A fuel injection system which has a compensating element including a support body having a dome-shaped support surface is described in German Published Patent Application No. 197 35 665. A fuel injection valve supports itself in a location bore of a cylinder head via the compensating element. A sealing ring is located in a groove of the fuel injection valve in the annular gap between the location bore and the fuel injection valve which seals the annular gap in relation to the combustion chamber. As a support surface of the fuel injection valve rests on spherical-shaped dome-surface, the fuel injection valve may be installed up to a certain angular misalignment to the axis of the locator bore and be pressed into the locator bore by suitable means, for example a clamping claw. In this manner, simple adjustment to the fuel supply lines is made possible. Tolerances from the manufacture and installation of the fuel injection valve may thus be compensated.

However, it is disadvantageous that this conventional arrangement, while allowing a greater tolerance angle, further amplifies the problem of sealing the annular gap between the locator bore and the fuel injection valve, since at a greater tipping angle the seal is produced only through the elasticity of the sealing ring, since it has a large cross-sectional surface and elasticity and has to seal even in the event of largely irregular pinching.

SUMMARY

The fuel injection valve according to the present invention may provide a reliable seal of the annular gap between the locator bore and the fuel injection valve which is made possible even in the event the fuel injection valve is pivoted relative to the axis of the locator bore over a relatively large angular range. In addition, the object of sealing the annular gap may be achieved in a manner which is simple and cost-effective to manufacture.

Other features of the fuel injection valve having a sealing ring are also described.

The fuel injection valve may have a valve seat support or nozzle body as a deep drawn part wherein the surface in the shape of a spherical sector may be manufactured especially cost-effectively, for example, by tumbling.

A fuel injection valve according to the present invention and, for illustration, a detail of a conventional fuel injection valve are illustrated in the drawings and are explained in more detail in the following description.

DETAILED DESCRIPTION

Figure 1:
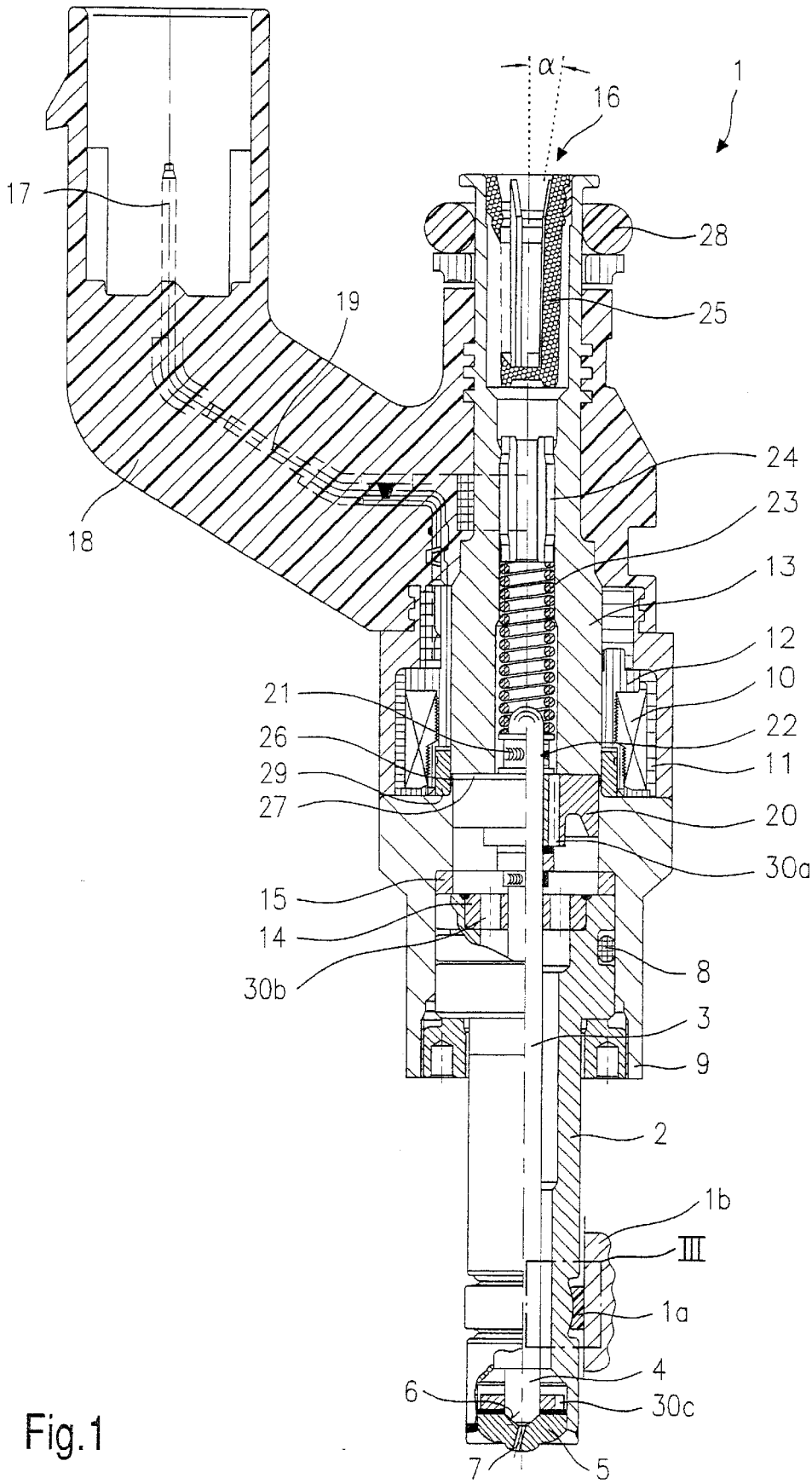
FIG. 1 is a cross-sectional view through a fuel injection valve having a sealing ring.

Fuel injection valve 1, as illustrated in FIG. 1, has a sealing ring 1*a* which is implemented in the form of a fuel injection valve for fuel injection systems of mixture-compressing, externally ignited internal combustion engines. Fuel injection valve 1 is inserted in a locator bore of cylinder head 1*b*. Cylinder head 1*b* is illustrated as a sectional plane in the region of sealing ring la, since this region, will be described in more detail in the following figures. Fuel injection valve 1 may provide for direct injection of fuel into a combustion chamber of an internal combustion engine.

Fuel injection valve 1 has a nozzle body 2 in which a valve needle 3 is guided. Valve needle 3 is mechanically linked with a valve closing body 4, which is combined with a valve seat surface 6 positioned on a valve seat body 5 into a seal seat. Fuel injection valve 1, in an example embodiment, is an inwardly opening fuel injection valve 1 having a spray opening 7. Nozzle body 2 is sealed by a seal 8 in relation to stationary pole 9 of a solenoid 10, which is used as an actuator. Solenoid 10 is encapsulated in a coil housing 11 and wound on a coil insulating frame 12 which presses against an internal pole 13 of solenoid 10. Internal pole 13 and stationary pole 9 are separated from another by a gap 26 and are supported on a connector component 29. Solenoid 10 is excited by an electrical current which may be supplied via an electrical plug-in contact 17 via a line 19. Plug-in contact 17 is enclosed by a plastic coating 18 which may be sprayed onto internal pole 13.

Valve needle 3 is guided in a valve needle guide 14 which is implemented in a disk shape. A paired adjustment disk 15 is used to set the stroke. An armature 20 is located on the other side of adjustment disk 15. This armature is positively connected via a flange 21 with valve needle 3, which is connected by a weld seam 22 with flange 21. A return spring 23, which is brought into pre-tension in the present configuration of fuel injection valve 1 by a sleeve 24, is supported on flange 21. Fuel channels 30*a* to 30*c*, which carry the fuel, which is supplied via a central fuel supply 16 and filtered by a filter element 25, to spray opening 7, extend in valve needle guide 14, in armature 20, and on valve seat body 5. Fuel injection valve 1 is sealed by a seal 28 in relation to a fuel inlet. Angle a indicated illustrates the desired ability to tip fuel injection valve 1 in order to compensate for a manufacturing tolerance or installation tolerance between the fuel inlet, not shown, and the locator bore.

In the rest stat e of fuel injection valve 1, armature 20 has return spring 23 applied to it against its stroke direction so that valve closing body 4 is kept pressed against valve seat 6 to form a seal. When solenoid 10 is excited, it builds up a magnetic field which moves armature 20 against the spring force of return spring 23 in the stroke direction, with the stroke being.predetermined by a working gap 27 existing between internal pole 13 and armature 20 in the rest position. Armature 20 also carries along flange 21, which is welded with valve needle 3, in the stroke direction. Valve closing body 4, which is mechanically linked with valve needle 3, lifts off of the valve seat surface and the fuel supplied to spray opening 7 via fuel channels 30*a* to 30*c* is sprayed.

If the solenoid current is switched off, armature 20 falls away from internal pole 13 after the magnetic field has decreased sufficiently, due to the pressure of return spring 23, upon which flange 21, which is mechanically linked with valve needle 3, moves against the stroke direction. Valve needle 3 is thus moved in the same direction, which places valve closing body 4 on valve seat surface 6 and closes fuel injection valve 1.

Figure 2:
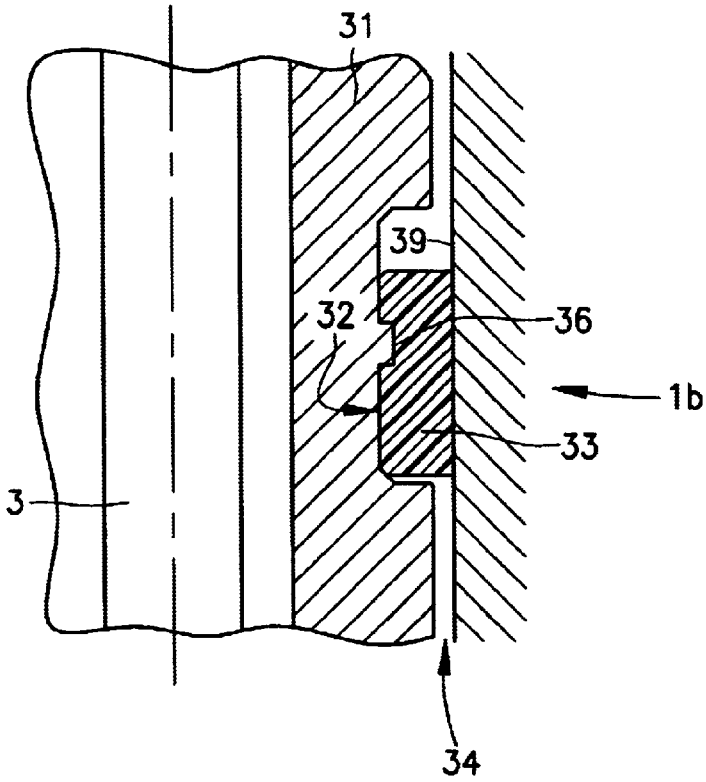
Fig. 2 Prior Art
FIG. 2 is an enlarged cross-sectional view corresponding to detail III of FIG. 1 in a fuel injection valve having a sealing ring according to a conventional configuration.

For illustration, FIG. 2 illustrates, in a detail which corresponds to detail III of FIG. 1, a fuel injection valve 31 having a sealing ring 33 according to a conventional configuration which deviates from a fuel injection valve 1 only in the region of detail III of FIG. 1. Fuel injection valve 31 has a peripheral groove 32, illustrated in cross-section, in which a sealing ring 33 is arranged. This sealing ring 33 seals annular gap 34, which is arranged between fuel injection valve 31 and a locator bore 39 of cylinder head 1*b*, in relation to a combustion chamber. A peripheral projection 36 in groove 32 supports the sealing effect of sealing ring 33, which is largely rectangular in cross-section.

If fuel injection valve 31 is now installed not exactly aligned with locator bore 39, but rather slightly tilted to compensate for tolerances, the surface pressure of sealing ring 33 is irregular. If the angle is too large, leaks may occur.

Figure 3:
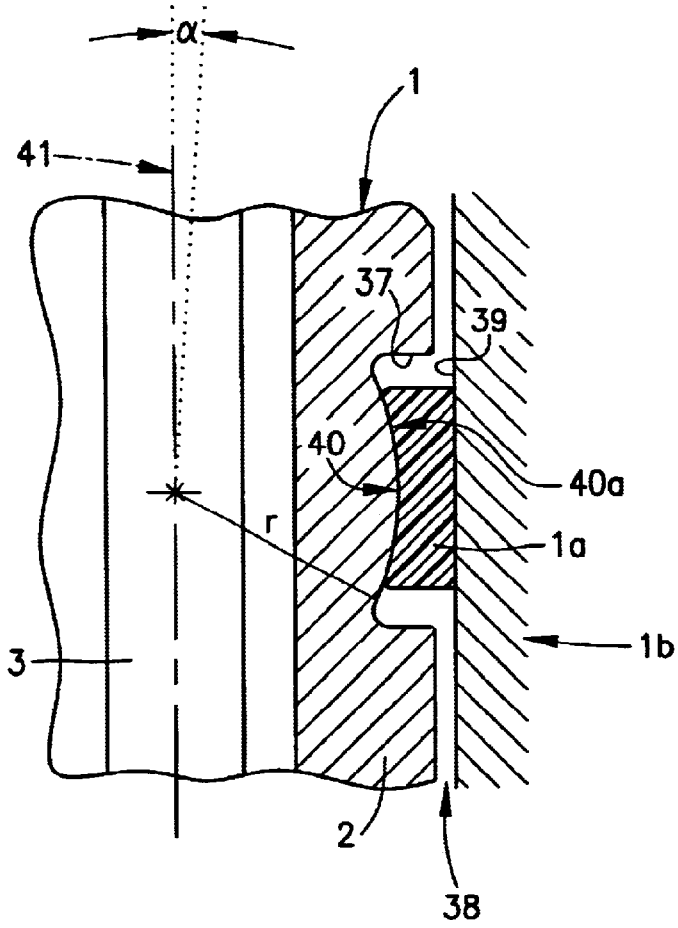
FIG. 3 is an enlarged cross-sectional view of detail III of FIG. 1.

FIG. 3 illustrates detail III of FIG. 1, which illustrates a fuel injection valve 1 according to the present invention. Corresponding components are provided with the same reference numbers.

Fuel injection valve 1 has a groove 37 on the outer circumference of its nozzle body 2, on which sealing ring la rests. This sealing ring 1*a* seals annular gap 38, which is arranged between fuel injection valve 1 and locator bore 39 of cylinder head 1*b*, in relation to a combustion chamber. A contact surface 40, having the shape of a spherical segment, of sealing ring 1*a*, which is concave in section, cooperates with a corresponding counter surface 40*a*, having the shape of a spherical segment, of fuel injection valve 1.

Surfaces 40, 40*a*, which have the shape of a spherical segment, have, for example, a radius r such that the center is arranged on a central axis 41 of fuel injection valve 1 and/or valve needle 3.

If fuel injection valve 1 is not installed exactly aligned with locator bore 39, but rather tilted by an angle α in order to compensate for tolerances, the surface pressure of sealing ring 1*a* remains uniform. Fuel injection valve 1 and sealing ring 1*a* slide on surfaces 40, 40*a*, which have the shape of a spherical segment, in an adjusted position, without sealing ring 1*a* being squeezed, since the center of rotation of surfaces 40, 40*a*, which have the shape of a spherical segment, is arranged exactly on center axis 41 of locator bore 39 and therefore is arranged in the center of rotation of a tilt by angle α. This is possible up to a relatively large angle. Sealing ring 1*a* may be made of a fluoropolymer, e.g., Teflon®. Other sealing materials, such as elastomer materials, may also be used for sealing ring 1*a*.

Counter surface 40*a*, having the shape of a spherical segment, of fuel injection valve 1 may be produced particularly cost-effectively if nozzle body 2 and/or a valve seat support is provided as a sheet metal deep drawn part on which counter surface 40*a*, having the shape of a spherical segment, is shaped, for example, by tumbling.

Figure 4:
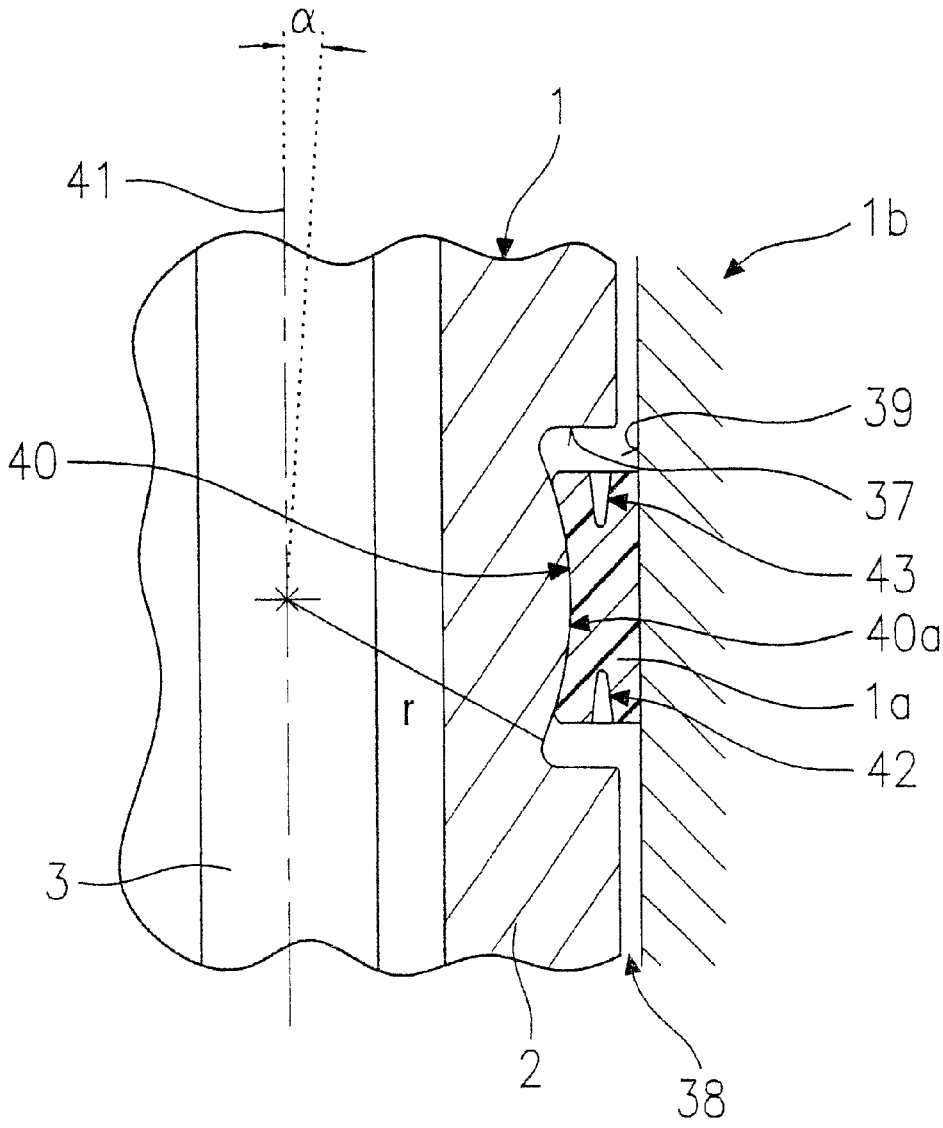
FIG. 4 is a cross-sectional view corresponding to detail III in FIG. 1 depicting a further example embodiment of a fuel injection valve having a sealing ring.

FIG. 4 illustrates, in an enlarged illustration corresponding to detail III in FIG. 1, a further example embodiment according to the present invention of a fuel injection valve 1 having a sealing ring 1*a*, which deviates in the implementation of sealing ring 1*a*. Therefore, corresponding components are also provided with the same reference numbers.

Fuel injection valve 1 has a groove 37 on the outer circumference of its nozzle body 2, in which sealing ring 1*a* is arranged. This sealing ring 1*a* seals annular gap 38, which is arranged between fuel injection valve 1 and locator bore 39 of cylinder head 1*b*, in relation to a combustion chamber. Sealing ring 1*a* has a lower peripheral groove 42 in a surface lying on the combustion chamber side in annular gap 38 between locator bore 39 and fuel injection valve 1. Sealing ring 1*a* has an upper peripheral groove 43 in a surface facing away from the combustion chamber in annular gap 38 between locator bore 39 and fuel injection valve 1. Upper groove 43 and lower groove 42 are each implemented, in the example embodiment, over approximately ¼ of the height of sealing ring 1*a*. A counter surface 40*a*, having the shape of a spherical segment, of fuel injection valve 1 works together with a corresponding contact surface 40, having the shape of a spherical segment, of sealing ring 1*a*, which is concave in section. Radius r of both surfaces 40, 40*a* is selected so that the center is arranged on a central axis 41 of fuel injection valve 1 and/or of valve needle 3.

Fuel injection valve 1 may be installed tipped by an angle α in order to compensate for tolerances. Through lower groove 42, the surface pressure in the lower section of contact surface 40 and counter surface 40*a*, which have the shape of a spherical segment, is increased if the combustion chamber pressure may act in lower groove 42 via annular gap 38. Through lower groove 42 and upper groove 43, the danger of deformation of sealing ring 1*a* in the event of tipping by angle α is reduced, since, in order to generate a sufficient sealing effect, such a high pre-tension through the elastic deformation of sealing ring 1*a* is not necessary and contact surface 40 and counter surface 40*a*, which have the shape of a spherical segment, may slide on one another more easily. Nonetheless, contact pressures sufficiently high to prevent penetration of combustion gases may be achieved.

What is claimed is:

1. A fuel injection valve insertable into a locator bore of a cylinder head of an internal combustion engine, comprising:

a sealing ring positioned peripherally around the fuel injection valve in the locator bore, the sealing ring including a contact surface to the fuel injection valve, the contact surface having a shape of a spherical segment and configured to press against a corresponding counter-surface of the fuel injection valve, the counter-surface having a shape of a spherical segment, wherein the sealing ring includes:

a lower peripheral groove in a surface arranged on a combustion chamber side in an annular gap between the locator bore and the fuel injection valve; and an upper peripheral groove in a surface facing away from the combustion chamber in the annular gap between the locator bore and the fuel injection valve.

2. The fuel injector valve according to claim 1, wherein both the upper groove and the lower groove are configured over approximately 0.25 of a height of the sealing ring.

3. A fuel injection valve insertable into a locator bore of a cylinder head of an internal combustion engine, comprising:

a sealing ring positioned peripherally around the fuel injection valve in the locator bore, the sealing ring including a contact surface to the fuel injection valve, the contact surface having a shape of a spherical segment and configured to press against a corresponding counter-surface of the fuel injection valve, the counter-surface having a shape of a spherical segment wherein the spherical segment shaped contact surface is configured to have a curvature over an entire height of the sealing ring.

4. The fuel injection valve according to claim 3, wherein the contact surface of the sealing ring is concave in cross-section.

5. A fuel injection valve insertable into a locator bore of a cylinder head of an internal combustion engine, comprising:

a sealing ring positioned peripherally around the fuel injection valve in the locator bore, the sealing ring including a contact-surface to the fuel injection valve, the contact surface having a shape of a spherical segment and configured to press against a corresponding counter-surface of the fuel injection valve, the counter-surface having a shape of a spherical segment, wherein the sealing ring includes a lower peripheral groove in a surface arranged on a combustion chamber side in an annular gap between the locator bore and the fuel injection valve.

6. A fuel injection valve insertable into a locator bore of a cylinder head of an internal combustion engine, comprising:

a sealing ring positioned peripherally around the fuel injection valve in the locator bore, the sealing ring including a contact surface to the fuel injection valve, the contact surface having a shape of a spherical segment and configured to press against a corresponding counter-surface of the fuel injection valve, the counter-surface having a shape of a spherical segment, wherein the sealing ring includes an upper peripheral groove in a surface facing away from a combustion chamber in an annular gap between the locator bore and the fuel injection valve.

7. The fuel injection valve according to claim 3, wherein a radius of the contact surface of the sealing ring and of the counter-surface of the fuel injection valve is dimensioned so that a center of rotation of the contact surface and the counter-surface is arranged on a central axis of the fuel injection valve.

8. The fuel injection valve according to claim 3, wherein the sealing ring is positioned in a peripheral groove of the fuel injection valve.

9. The fuel injection valve according to claim 8, wherein the peripheral groove is shaped on at least one of a nozzle body and a valve seat carrier.

10. The fuel injection valve according to claim 9, wherein the at least one of the nozzle body and the valve seat carrier includes a deep drawn part onto which the counter-surface of the fuel injection valve is shaped.

11. The fuel injection valve arrangement according to claim 3, wherein the sealing ring is made of at least one fluoropolymer.

12. The fuel injector valve according to claim 5, wherein the lower groove is configured over approximately 0.25 of a height of the sealing ring.

13. The fuel injector valve according to claim 6, wherein the upper groove is configured over approximately 0.25 of a height of the sealing ring.

14. The fuel injector valve according to claim 3, wherein the counter-surface of the fuel injector valve has at least one curvature over the entire height of the sealing ring.

15. The fuel injector valve according to claim 3, wherein the curvature of the spherical segment-shaped contact surface of the sealing ring is configured with a constant radius.

16. The fuel injector valve according to claim 3, wherein a curvature of the segment-shaped counter surface of the fuel injector is configured with a constant radius.

* * * * *